US005996846A

United States Patent [19]

Martindale

[11] Patent Number: 5,996,846

[45] **Date of Patent: *Dec. 7, 1999**

[54] DIRECT VALVELESS CONDIMENT DISPENSING SYSTEM

[75] Inventor: Richard A. Martindale, Vacaville, Calif.

[73] Assignee: Automatic Bar Controls, Inc., Vacaville, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/969,992

[22] Filed: Nov. 13, 1997

Related U.S. Application Data

[63] Continuation of application No. 08/630,828, Apr. 10, 1996, abandoned.

[51] Int. Cl.[6] ..... B67D 5/60

[52] U.S. Cl. ..... 222/132; 222/136; 222/334

[58] Field of Search ..... 222/132, 134, 222/144.5, 136, 341, 334

[56] References Cited

U.S. PATENT DOCUMENTS

| | | | |
|---|---|---|---|
| 3,695,314 | 10/1972 | Watts et al. | 222/144.5 |
| 5,158,210 | 10/1992 | Du | 222/144.5 |
| 5,230,443 | 7/1993 | Du | 222/134 |
| 5,366,117 | 11/1994 | Mesenbring et al. | 222/132 |

*Primary Examiner*—Philippe Derakshani
*Attorney, Agent, or Firm*—Townsend and Townsend and Crew LLP

[57] ABSTRACT

The invention relates to a condiment dispensing system for dispensing condiment and the like which includes a gas operated pump for moving condiment(s) from a condiment source to a delivery nozzle through a condiment conduit which is valveless to thus prevent splatter of the delivered condiment due to entrained gas. A gas-operated pump is controlled at the delivery nozzle to effect delivery of the condiment.

8 Claims, 2 Drawing Sheets

DIRECT VALVELESS CONDIMENT DISPENSING SYSTEM

This application is a continuation of and claims priority from U.S. Ser. No. 08/630,828, now abandoned, which was filed on Apr. 10, 1996.

BACKGROUND OF THE INVENTION

The invention relates to a system for dispensing condiments or the like. It is specially adapted to dispense condiments that contain solids or semi solids or particles such as is found in thousand island dressing and various "secret sauces" favored by restaurants without fouling the dispensing system. The invention provides for dispensing condiment rapidly and efficiently and without valves in the condiment dispensing conduits. The invention is particularly adapted to handle condiments that contain residual air or other gases without causing the condiment to splatter when delivered.

At present, condiment packers are unable to remove all air from the condiment during manufacturing or packing. Additionally, small $CO_2$ gas or atmosphere air leaks can cause the pump to suck air into the system, literally blending this air with the condiment. The air or gas can cause condiment to splatter at the nozzle when it exits under pressure.

Typically, this air in prior art systems has been trapped within the condiment between pump condiment outlet and dispensing head on/off valve. When the condiment button is deactivated, the mechanical valve seals off, which in turn stops the condiment flow and thereby stops the pump. At the time of deactivation, pressure is trapped between pump outlet and the valve at the delivery nozzle. When the condiment button in the delivery nozzle is depressed again, and if an air pocket is within a few feet of the nozzle, the air bubble exits the delivery nozzle with sufficient velocity to cause "spitting" (splattering, spraying) within the immediate area. This can soil a customer's clothes and is a problem for the equipment user.

Heretofore there have been many systems developed for dispensing condiments automatically and in controlled portions. For example, U.S. Pat. No. 5,366,117, issued to John M. Mesenbring et al., provides a condiment dispensing system. The Background section of that patent describes many of the prior art methods and systems for dispensing condiments and the problems associated therewith. The Mesenbring et al. patent provides a system for selectively dispensing condiments for items of food, including a plurality of condiment containers, a dispenser head having a plurality of input passages, an outlet nozzle, and valves for controlling fluid flow from each of the input passages to the outlet nozzle, a plurality of fluid flow lines, with a line connecting each condiment container to a corresponding dispenser head input passage, and a fluid pump in each of the fluid flow lines whereby an operator can dispense selected condiments in controlled portions if desired from the nozzle onto a food item. Arrangements for daily and bi-weekly sanitizing of the system are also provided. The patent provides for the use of a dispensing head having a plurality of input passages which can be fouled during delivery of viscous condiments particularly by condiments that contain solid or semi solid particles.

Another approach to dispensing condiments is disclosed in U.S. Pat. No. 5,158,210 to Benjamin R. Du. The Background section of the Du patent also discusses prior art methods of dispensing condiments. The Du patent provides an improved condiment dispensing system for delivering a measured quantity of condiment as a constant flow rate. The device comprises a pump which is fluidly connected to a condiment source and a dispensing apparatus. The dispensing apparatus includes a valve assembly which is connected to both a pressurized fluid source and to the pump whereby actuation of a valve assembly contained on the surface of the dispensing apparatus causes a measured quantity of condiment to be dispensed from an outlet nozzle contained thereon. The pump of the Du patent is provided with two cavities which in operation alternately withdraw a predetermined quantity of condiment from a condiment source and dispense the predetermined quantity of condiment at a desired location.

There is still need for a condiment dispensing system which can handle condiments including viscous condiments and/or condiments with solid or semi solid particles in an efficient manner without fouling and which may contain air or other gases without splatter at the delivery nozzle.

SUMMARY OF THE INVENTION

This invention provides a condiment dispensing system which includes a rack for holding a source of condiment. The source of condiment is preferably a condiment containing collapsible bag having an outlet port. A gas driven pump is provided and has a condiment inlet and a condiment outlet and a gas inlet for operating the pump. Conduit means connect the outlet port of the source of condiment with the condiment inlet of the pump. A source of gas such as $CO_2$ or air under pressure is used in the system to power the pump. A gas conduit connects the source of gas with the gas inlet of the pump through a delivery nozzle that has control valves to control the flow of gas to one or more pumps. The delivery nozzle, having no valves on the condiment dispensing conduit, is used to dispense the condiment. A delivery conduit connects the delivery nozzle with the condiment outlet of the pump. The gas control valves on the delivery nozzle are used to flow gas to a selected pump to deliver condiment through the delivery conduit. Thus, the present invention provides a condiment dispensing system including a rack for holding one or more sources of condiment. The condiment source is preferably a bag-type container having an outlet port. A gas driven pump is provided and has a condiment inlet and a condiment outlet. The pump has a gas inlet for operating the pump. A conduit connects the outlet port of the source of condiment with the condiment inlet of the pump. A source of gas under pressure is provided as well as a delivery nozzle having at least one gas inlet and at least one gas outlet. A valve means is operatively positioned in the delivery nozzle for controlling gas flow therethrough. The delivery nozzle has at least one passageway for flowing condiment therethrough. A first gas conduit connects the source of gas with the gas inlet of the nozzle and a second gas conduit connects the gas outlet of the delivery nozzle with the gas inlet of the pump. A delivery conduit connects the passageway of the delivery nozzle with the condiment outlet of the pump.

OBJECTS OF THE INVENTION

It is a particular object of the present invention to provide an improved system for dispensing condiment or the like which system can handle viscous condiments and condiments containing solid or semi solid particulate matter or air or other gases without jamming and with positive flow control and with no splatter when the condiment is delivered. Other objects and advantages of the present invention will be apparent from the following detailed description read in view of the accompanying drawings which are made a part of this specification.

DETAILED DESCRIPTION OF THE INVENTION

Figure 1:
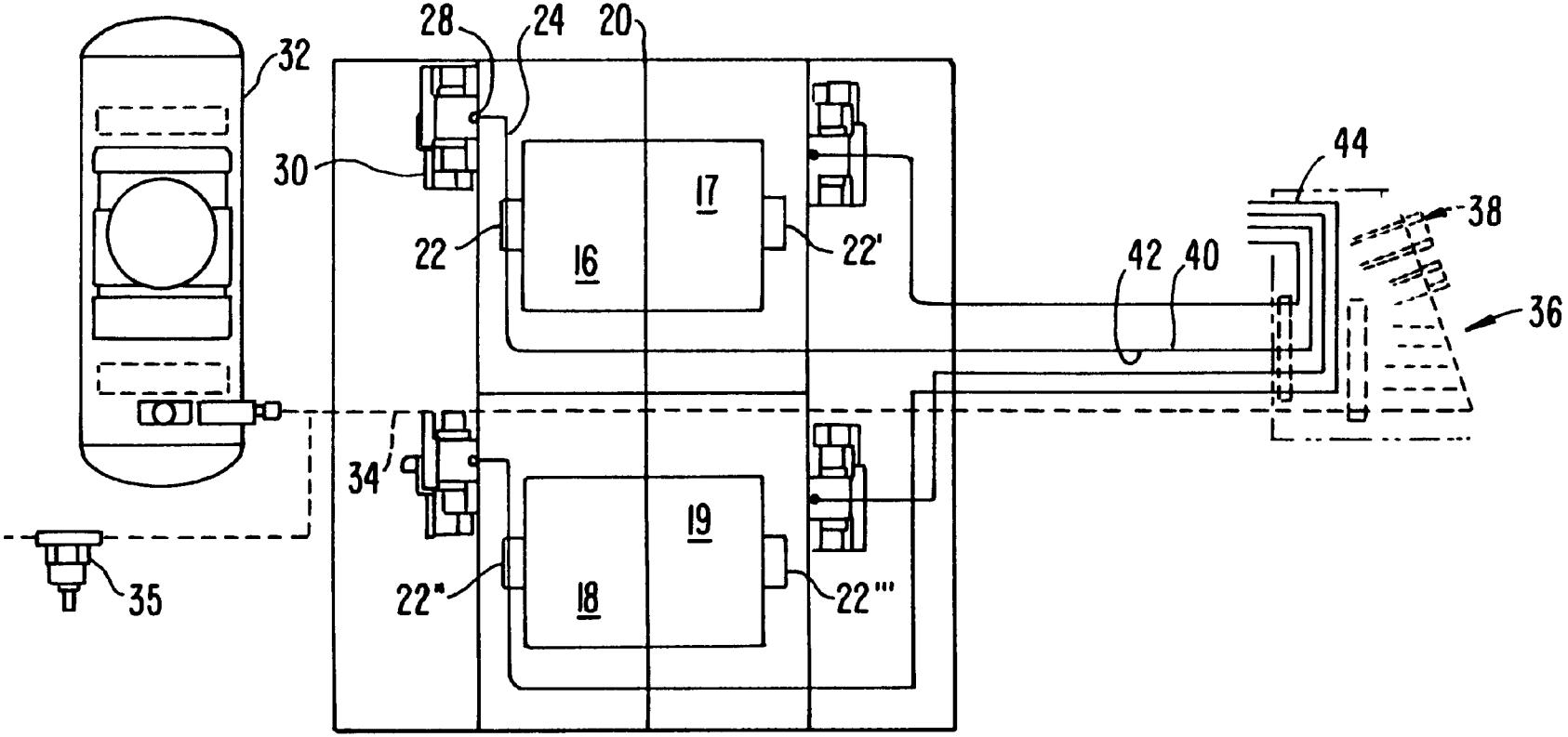
FIG. 1 is a schematic diagram illustrating the preferred system for dispensing condiment and shows an embodiment of apparatus assembled in accordance with the present invention.

The preferred system for dispensing condiment or the like is illustrated schematically in FIG. 1. The condiment dispensing system of FIG. 1 provides for handling condiments in a manner to prevent fouling of the system and splatter, particularly at the delivery nozzle. This is true, particularly when the condiment contains solid or semi-solid particles or air or other gases such as is found in thousand island dressing or various "secret sauces" found in many restaurants.

As noted, condiment packers are unable to remove all air from the condiment during manufacturing or packing. Additionally, small $CO_2$ gas or atmosphere air leaks can cause the pump to suck air into the system, literally blending this air with the product. This air can cause condiment to splatter at the nozzle when it exits under pressure. The valveless design of the present invention that switches gas on or off to the pump (rather than stopping flow of condiment in the condiment conduit) as a means of controlling the pump resolves this problem. An in-line on/off valve on the condiment conduit not being necessary, condiment is at zero pressure upon deactivation of the pump. Therefore, when condiment button at the delivery nozzle is once again depressed to start the pump, there is no pressure in the condiment conduit to cause the air to exit the delivery nozzle at a sudden rapid velocity. Therefore, spitting, splattering, and the subsequent mess associated with the resultant condiment spray is eliminated. The system for accomplishing this is described herein.

Referring now specifically to FIG. 1, a rack 20 for holding a source of condiment is shown. As is well known, condiment is commercially available in convenient condiment bags. The embodiment of FIG. 1 shows four bags 16–19 which might be, for example, mayonnaise, ketchup, mustard and barbecue sauce. The bags are made to be hung on a rack or to be otherwise supported at a desired location and the condiment withdrawn for use. Thus rack 20 may be in a form suitable for hanging a condiment bag. Alternatively, rack 20 may be formed in the shape of a cradle for supporting the condiment bag. In any event, the bags are formed with a condiment outlet 22, 22', 22", 22'". For simplicity's sake, the following discussion is directed to condiment bag 16 having condiment outlet 22. The outlet 22 is connected to a conduit 24. Conduit 24 provides a flow path from the condiment bag to the suction or inlet side 28 of a condiment pump 30.

The condiment pump 30 is preferably a dual diaphragm type pump. There are commercially available pumps that are useful in the present invention. One such pump for example is Model No. "Smooth" 166-200-11 by Shurflow of Santa Ana, Calif. 92706. However, any suitable type pump may be used. The pump is preferably gas driven. A source of gas, for example $CO_2$ or air source 32, is operatively connected by gas conduit 34 to the operating handle or tower indicated by the number 36 through a valve 38 and then to pump 30 by gas conduit 40. A pressure regulator 35 may be used to control pressure in conduit 34. The valve 38 is normally closed, and no gas flows to the pump 30. When valve 38 is opened, the pump 30 will be activated by gas flowing through the above-described gas conduits 34, 40.

A condiment conduit 42 is directly connected between the outlet of the pump 30 and the operating handle or tower 36. There are no valves on the condiment conduit 40 or in the operating handle or tower 36. Thus, the condiment delivery conduit is free flowing. When valve 38 in the operating handle or tower 36 is opened to permit gas flow to the pump 30, the pump 30 moves condiment to the operating handle or tower 36 for dispensation out nozzle 44.

Figure 2:
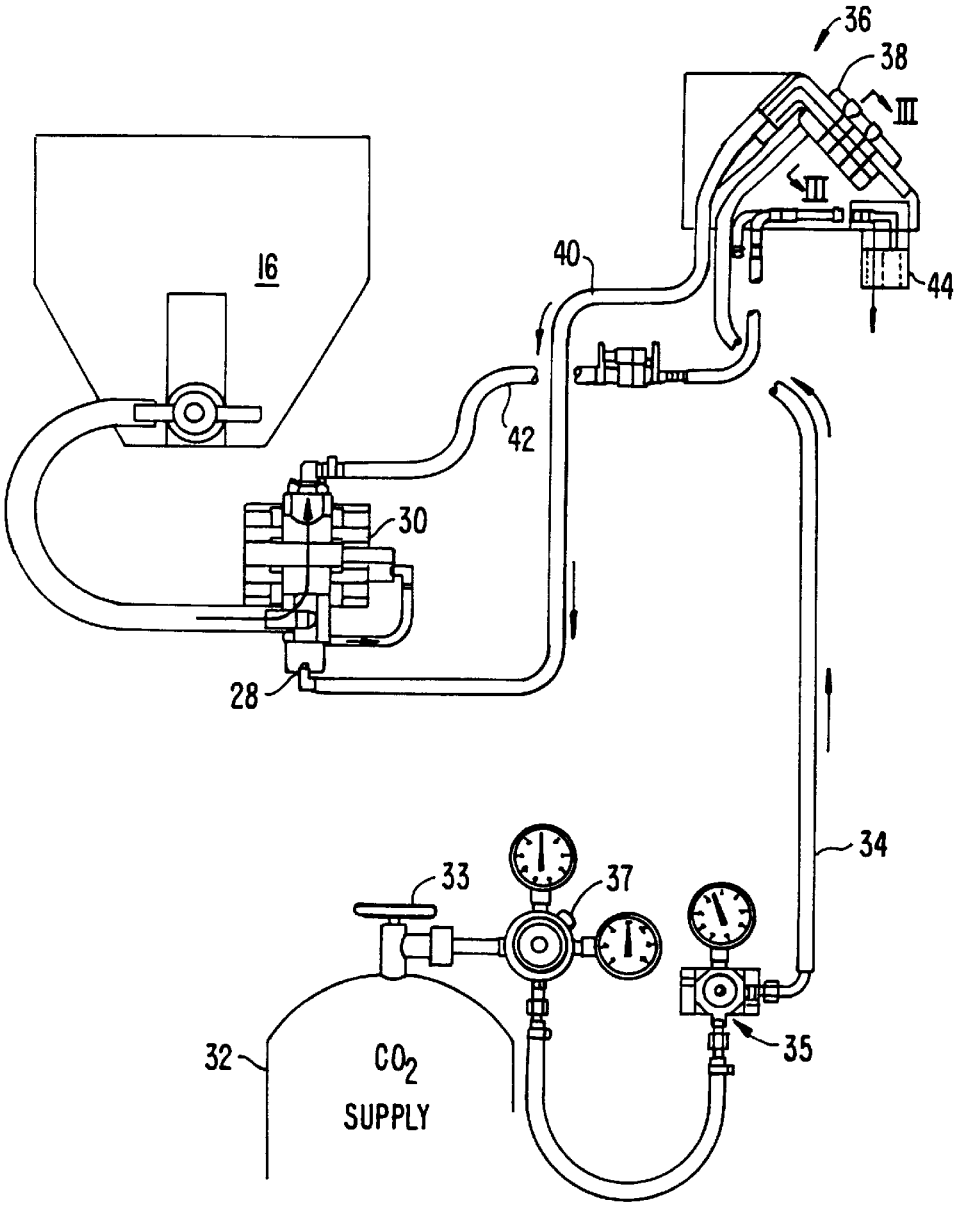
FIG. 2 is an enlarged schematic diagram and shows in more detail portions of the preferred system for dispensing condiment.
Figure 3:
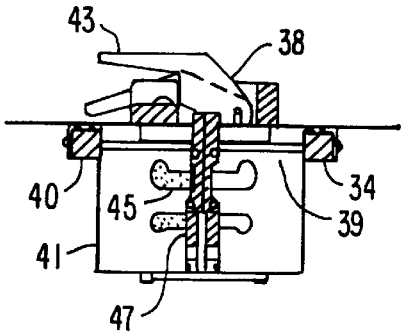
FIG. 3 is a sectional view taken at line III—III of FIG. 2.

FIG. 2 is an enlarged schematic diagram of a portion of the dispensing system shown in FIG. 1. Parts in FIG. 2 that are also shown in FIG. 1 will be given the same number. Thus, a source of gas 32 is connected through valve 33, meter 37 and pressure regulator 35 by means of conduit 34 to the operating handle or tower 36. The conduit 34 is connected into valve 38. Valve 38 is normally closed to prevent gas flow therethrough. FIG. 3 is an enlarged sectional view taken at III—III of FIG. 2 and shows valve 38 in more detail as will be described below. Conduit 40 is connected downstream of valve 38 and extends to the pump 30 where it is operably connected to the suction side 28 of the pump. A condiment conduit 42 is connected between the outlet of the pump 30 and the delivery nozzle 44 in the operating handle tower 36. When valve 38 is opened, the pump is activated by the gas flowing through the gas conduits 34, 40. The pump 30 draws condiment from the bag in the box source 16 which flows through the condiment conduit through the flow control 41 and then out nozzle 44. Flow control 41 is a control with an adjustable orifice for use in controlling flow of condiments of different viscosities. There are no operating valves on the condiment conduit 42.

Valve 38 shown in FIG. 3 is connected at the delivery nozzle 44 on a suitable tower 36 for controlling the flow of gas from the gas source 32 through conduit 34 then through the opening 39 in the valve body 41 when the valve lever 43 is depressed as shown in phantom in FIG. 3 to depress valve stem 45 to align the openings. A spring 47 is used to return the valve to a closed position when pressure on lever 43 is released. The invention is illustrated with a tower to hold the delivery nozzle 44. As is well known in the art, the delivery nozzle may also be utilized in a hand-held dispenser.

Thus, the present invention provides apparatus and method of dispensing condiment from a condiment source including the steps of providing a valveless free-flowing conduit from the condiment source to an open delivery nozzle and providing a gas-operated pump operatively connected to the source of condiment. A pump is operatively connected to a source of gas through the delivery nozzle. A gas control valve is provided on the delivery nozzle to control gas flow to the pump whereby opening the gas control valve causes flow of gas to the pump causing condiment to flow out of the delivery nozzle without splatter.

The principles, preferred embodiments and modes of operation of the present invention have been described in the foregoing specification. However, the invention which is intended to be protected is not to be construed as limited to the particular embodiments disclosed. The embodiments are to be construed as illustrative rather than restrictive. Variations and changes may be made by others without departing from the spirit of the present invention. Accordingly, all such variations and changes which fall within the spirit and scope of the present invention as defined in the following claims are expressly intended to be embraced thereby.

What is claimed is:

1. A condiment dispensing system comprising a source of condiment; a gas driven pump operatively connected with said source of condiment for moving said condiment; a source of gas under pressure; a delivery nozzle having at least one gas inlet and at least one gas outlet, a valve having an open position and a closed position in said delivery nozzle for controlling gas flow therethrough and at least one passageway for flowing condiment therethrough, said one passageway for flowing condiment therethrough being open and having no valves thereon to provide for free flow of condiment; first gas conduit means connecting said source of gas with the gas inlet of said nozzle; second gas conduit means connecting the gas outlet of said delivery nozzle with said pump; and a continuous-flowing valveless delivery conduit connecting said source of condiment to said delivery nozzle for delivering condiment to said delivery nozzle from said source of condiment, whereby when said valve in said delivery nozzle is in the open position condiment will freely flow from said source of condiment through the continuous-flowing valveless delivery conduit and the at least one passageway and out of said nozzle.

2. The apparatus of claim 1 further characterized in that a plurality of pumps and sources of condiments are connected for flow through a plurality of condiment outlets in said delivery nozzle.

3. A condiment dispensing system comprising a rack for holding a source of condiment having an outlet port; a gas driven pump operatively connected with said source of condiment and having a gas inlet for operating said pump to move said condiment; a source of gas under pressure; a delivery nozzle having at least one gas inlet and at least one gas outlet, a valve having an open position and a closed position in said delivery nozzle for controlling gas flow therethrough and at least one passageway for flowing condiment therethrough, said one passageway for flowing condiment therethrough being open and having no valves thereon to provide for free flow of condiment; first gas conduit means connecting said source of gas with the gas inlet of said nozzle; second gas conduit means connecting the gas outlet of said delivery nozzle with the gas inlet of said pump; and a continuous-flowing delivery conduit means connecting the passageway of said delivery nozzle with said source of condiment, whereby when said valve in said delivery nozzle is in the open position condiment will freely flow from said source of condiment through the continuous-flowing delivery conduit means and the at least one passageway and out of said nozzle.

4. A method of dispensing condiment from a condiment source comprising the steps of providing a valveless continuous-flowing conduit from said condiment source to an open delivery nozzle whereby condiment can freely flow therethrough; providing a gas-operated pump operatively connected to said source of condiment; connecting said pump to a source of gas through said delivery nozzle; providing a gas control valve having an open position and a closed position on said delivery nozzle to control gas flow to said pump whereby opening said gas control valve to the open position causes flow of gas to said pump causing condiment to flow out of said delivery nozzle as long as said gas control valve is in the open position.

5. The method of claim 4 where closing said gas control valve stops the flow of condiment out of said nozzle.

6. A condiment dispensing system comprising a source of condiment; a gas driven pump operatively connected with said source of condiment for moving said condiment; a source of gas under pressure; a delivery nozzle having at least one passageway for flowing condiment therethrough, said delivery nozzle being coupled with said pump and being operable between an open position to activate said pump for flowing condiment to said delivery nozzle and a closed position to deactivate said pump; and a continuous-flowing valveless delivery conduit connecting said source of condiment to said delivery nozzle for delivering condiment to said delivery nozzle from said source of condiment; whereby when said delivery nozzle is in the open position condiment will freely flow from said source of condiment through the continuous-flowing valveless delivery conduit and the at least one passageway and out of said nozzle.

7. The condiment dispensing system of claim 6 wherein said delivery nozzle includes at least one gas inlet and at least one gas outlet, and a valve for controlling gas flow therethrough, said system further comprising a first gas conduit connecting said source of gas with the gas inlet of said delivery nozzle; and a second gas conduit connecting the gas outlet of said delivery nozzle with said pump.

8. The condiment dispensing system of claim 6 wherein said at least one passageway for flowing condiment through the delivery nozzle is open and has no valves thereon to provide for free flow of condiment.

* * * * *